United States Patent [19]

Adams

[11] 4,413,310

[45] Nov. 1, 1983

[54] LIGHT ASSEMBLY FOR A SEWING MACHINE

[75] Inventor: Kenneth D. Adams, Madison, N.J.

[73] Assignee: The Singer Company, Stamford, Conn.

[21] Appl. No.: 408,383

[22] Filed: Aug. 16, 1982

[51] Int. Cl.[3] ..... D05B 79/00

[52] U.S. Cl. ..... 362/90; 362/33; 362/285; 362/372; 362/418

[58] Field of Search ..... 362/90, 33, 285, 372, 362/418

[56] References Cited

U.S. PATENT DOCUMENTS 2,007,794 7/1935 Dawson ..... 362/90
2,226,689 12/1940 Barber ..... 362/90

FOREIGN PATENT DOCUMENTS 817995 5/1950 Fed. Rep. of Germany .
838682 9/1950 Fed. Rep. of Germany .
842299 9/1950 Fed. Rep. of Germany .
206579 12/1952 Spain .

*Primary Examiner*—Stephen J. Lechert, Jr.
*Attorney, Agent, or Firm*—William V. Ebs; Robert E. Smith; Edward L. Bell

[57] ABSTRACT

A sewing machine is provided with a slidable bulb carrying bracket like member and a bulb cover with which the member may be moved between: (1) an elevated position wherein the bulb is protected both by the bulb cover and surrounding structure of the head end portion of the machine; and (2) a lowered position wherein the bulb is accessible for removal and replacement.

9 Claims, 6 Drawing Figures

LIGHT ASSEMBLY FOR A SEWING MACHINE

DESCRIPTION

BACKGROUND OF THE INVENTION

1. Field of the Invention:

The invention relates to light carrying arrangements for sewing machines.

2. DESCRIPTION OF THE PRIOR ART

It is common practice to provide a sewing machine with a light bulb to illuminate work in the vicinity of the needle and to locate such bulb in a concealed protected position above the bed of the machine. However, the concealed bulb is difficult to remove when replacement becomes necessary.

It is a prime object of the present invention to provide an improved lighting arrangement for a sewing machine permitting a work illuminating light bulb to be located in a concealed protected position above the bed when sewing operations are to be performed, and in an exposed readily accessible position when the bulb is to be removed from and replaced in a light socket.

It is another object of the invention to provide an improved lighting arrangement for a sewing machine including means for locking a light carrying assembly in a protected position in the head end portion of a machine and for moving the assembly out of such position to facilitate removal and replacement of a light bulb.

Other objects and advantages of the invention will become apparent during a reading of the specification taken in connection with the accompanying drawings.

SUMMARY OF THE INVENTION

A sewing machine is provided in accordance with the invention with a lighting arrangement including a bracket-like member which is slidably mounted in the head end portion of the machine and is adapted to carry a light bulb socket. A transparent or grill-like light bulb cover is operably connected to the bracket-like member and serves to move said member between: (1) an elevated position in which a bulb in the socket is protected by the bulb cover and surrounding structure of head end portion of the machine; and (2) a lowered position in which the bulb is accessible for removal and replacement.

DESCRIPTION OF THE PREFERRED EMBODIMENT

Figure 2:
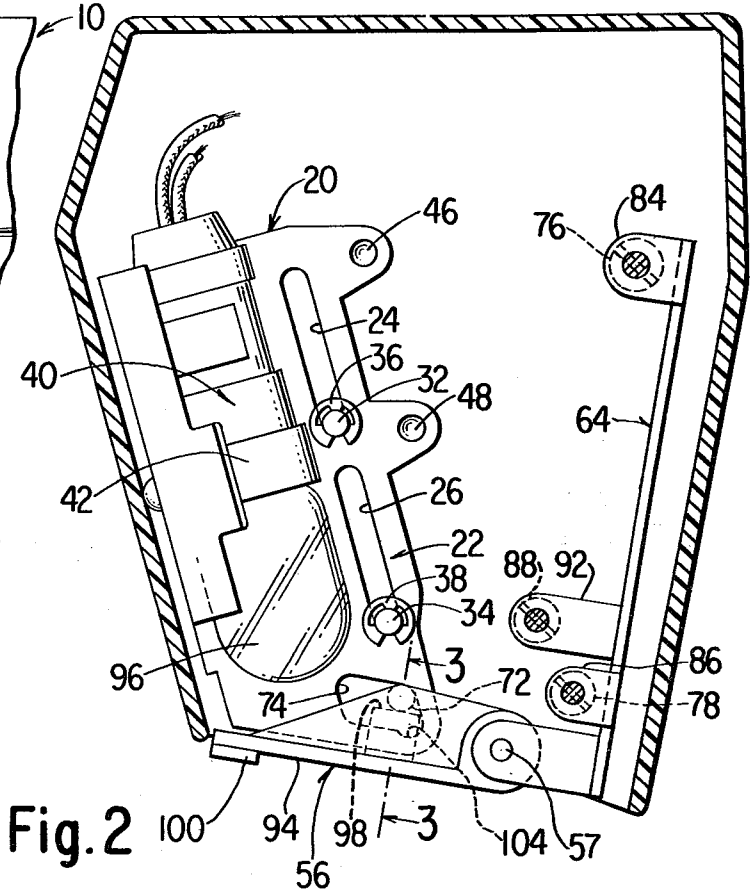
FIG. 2 is a sectional view taken on the plane of the line 2—2 of FIG. 1.
Figure 3:
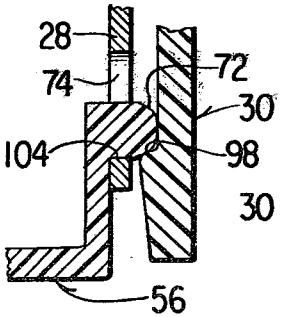
FIG. 3 is a fragmentary sectional view taken on the plane of line 3—3 of FIG. 2.

Referring to the drawings, reference character 10 designates the head end portion of a sewing machine overhanging a bed 12. A needle bar 14 reciprocable in endwise fashion in the head end portion 10 of the machine carries a sewing needle 16 which cooperates with looptaking mechanism (not shown) in the bed to provide for the formation of stitches in fabric moved under the needle across a work supporting surface 18 of the bed. A light carrying assembly 20 is installed in the head end portion of the bed in accordance with the invention to provide for the illumination of work being sewn on the machine.

Light assembly 20 includes a bracket like member 22 with elongate slots 24 and 26 in one side 28. Such member 22 is slidably mounted in a molded plastic end cover 30 on pins 32 and 34 which are affixed therein and which extend through the slots, to engage clamping rings 36 and 38 respectively. The assembly further includes a light bulb socket 40 which is affixed to member 22 as with internal spring, clip-like formations 42 thereon. Protrusions 46 and 48 on the one side 28, of member 22, engage inside surface 50 of cover 30, and a flange 52 on the opposite side of the member engages a plate 54 in the head end portion of the machine to guide sliding motion of member 22.

Member 22 operably connects with a light bulb cover 56 which is pivotally mounted within the machine at pins 57 and 58 on the cover 56 extending into a hole 60 in a flange 62 on a bracket 64 and with a hole 66 in a boss 68 on end cover 30. As shown, cover 56 includes a flanged portion 70 with a side projecting pin 72 which engages the member 22 in a slot 74. Engagement of pin 72 with the member 22 in slot 74 during pivotal movement of the cover causes member 22 to slide on pins 32 and 34, and to be moved upwardly and downwardly in the cover 30. Bracket 64 is affixed to plate 54 with screws 76 and 78 extending through holes 80 and 82 in flanges 84 and 86 on the bracket, and to end cover 30 with a screw 88 extending from the cover into a threaded hole 90 in a bracket flange 92.

Figure 1:
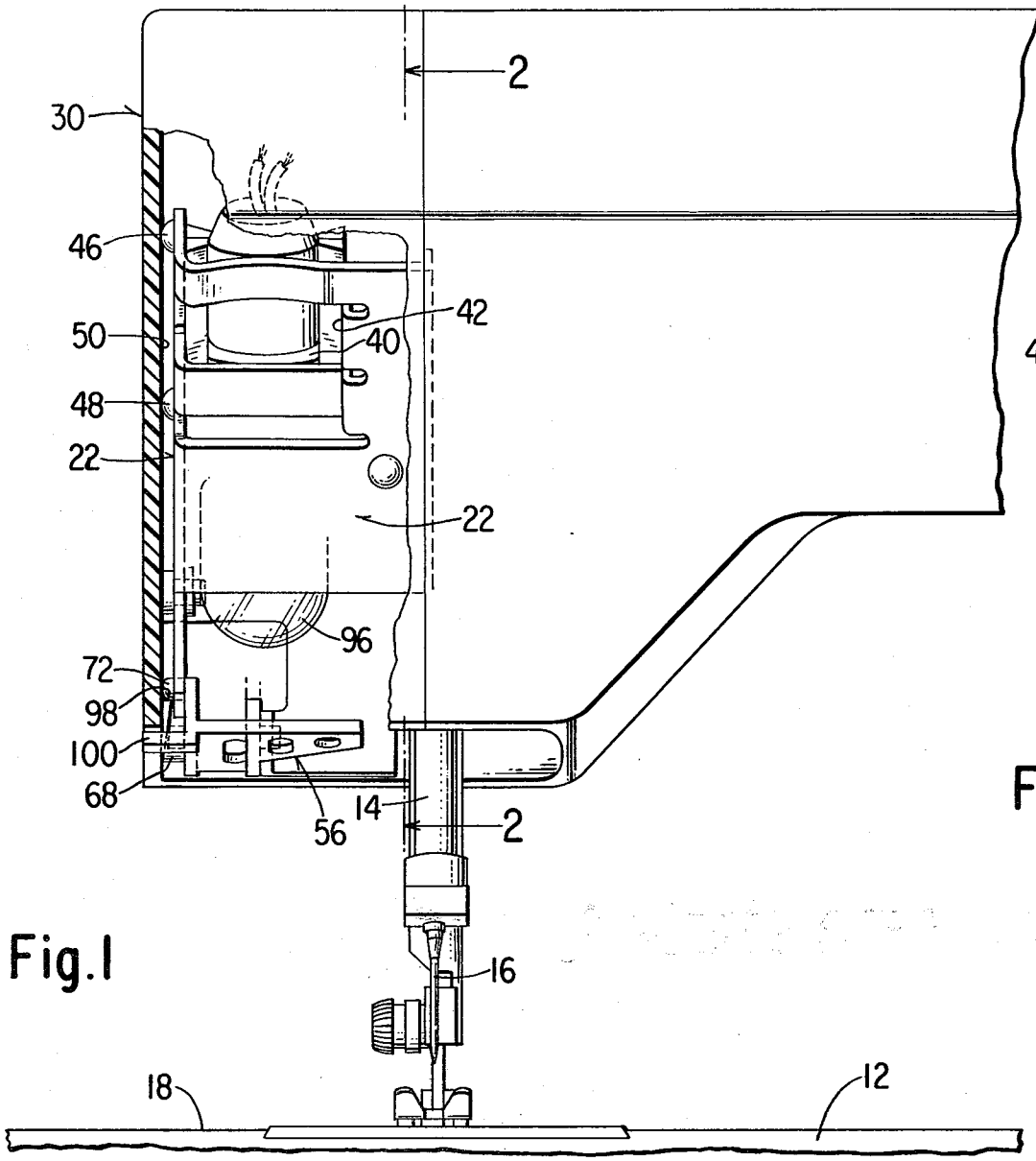
FIG. 1 is a fragmentary front elevational view of the head end portion of a sewing machine equipped with a light bulb assembly according to the invention and broken away to show structure of the assembly in an elevated position.
Figure 5:
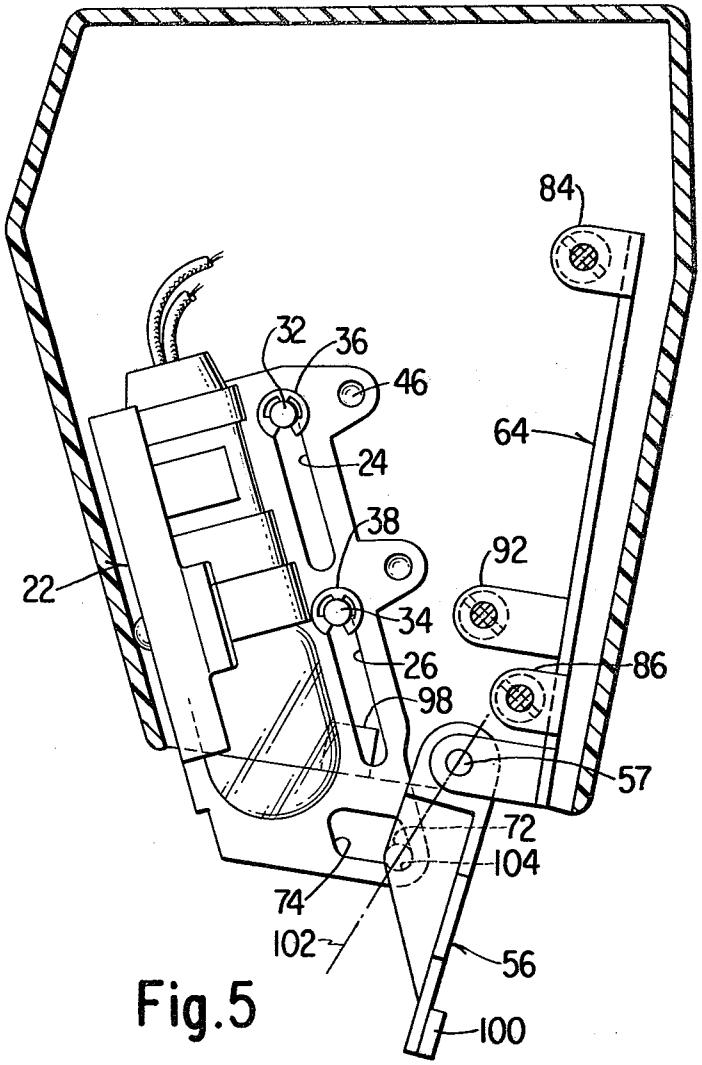
FIG. 5 is a sectional view taken on the plane of the line 5—5 of FIG. 4.
Figure 4:
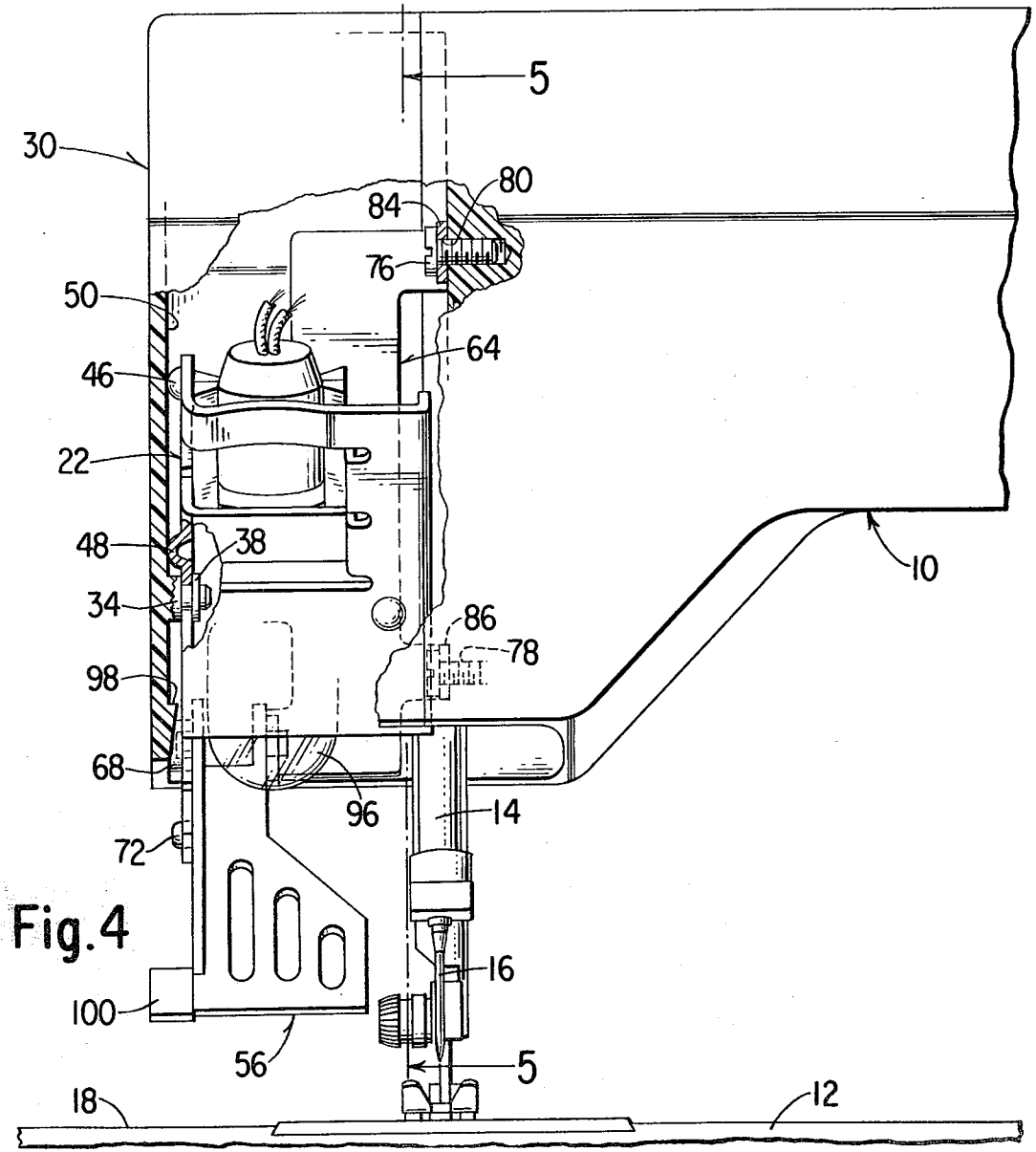
FIG. 4 is a view similar to FIG. 1 showing the light bulb assembly in a lowered position.
Figure 6:
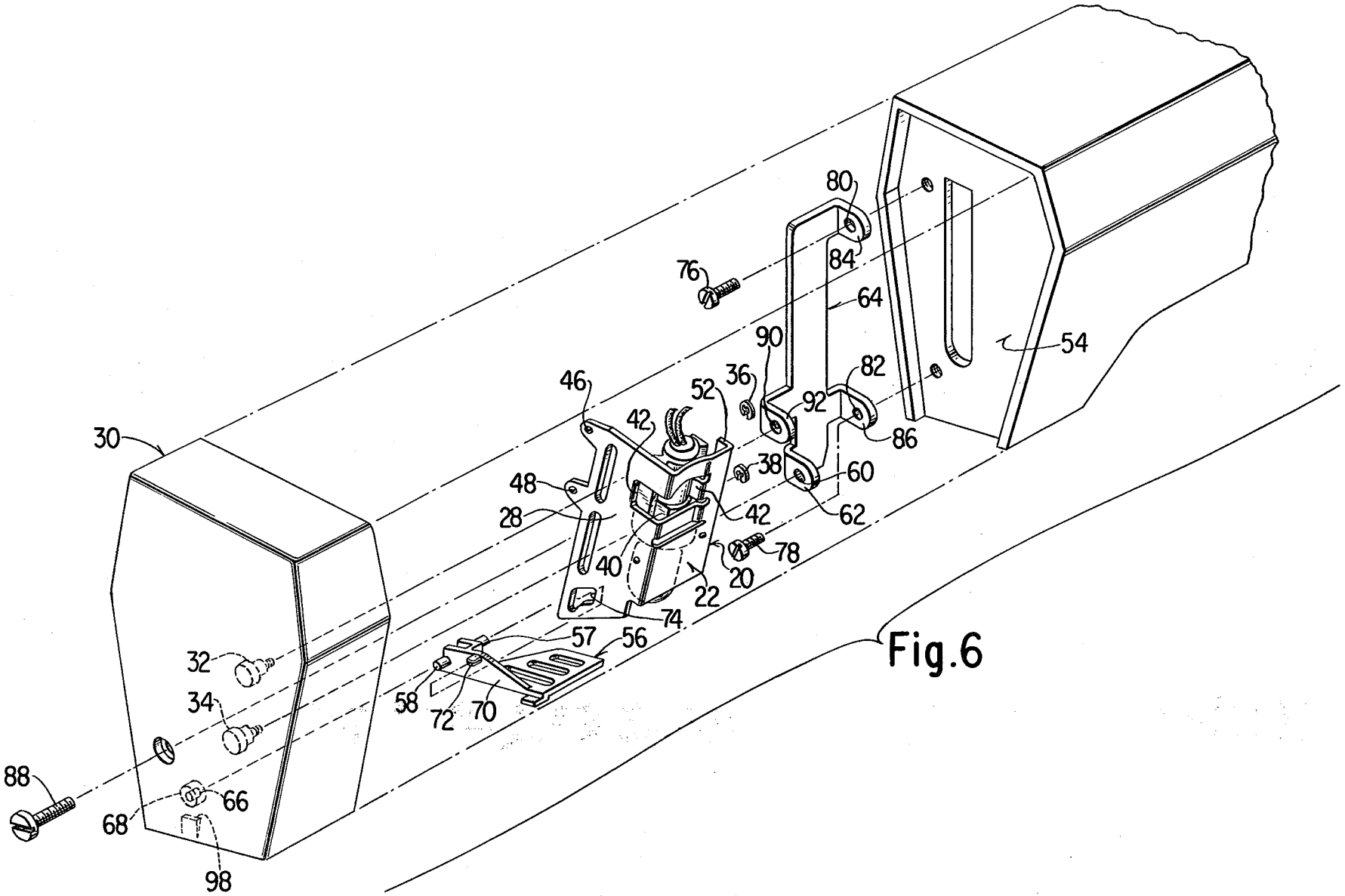
FIG. 6 is a disassembled perspective view of the head end portion of the sewing machine.

Cover 56 is preferably a clear plastic part through which light may readily pass, although an opaque material may also be used if a surface 94 disposable between a bulb 96 in socket 40 and work on bed supporting surface 18 is in the form of a grill permitting light to pass therethrough to the work. Cover 56 is normally disposed in a raised bulb protecting position (see FIGS. 1 and 2). In such position of the cover 56, bracket like member 22 is in an elevated position in cover 30, the bulb is up in the cover, and cover surface 94 is in a protective position under the bulb. Member 22 and cover 30 are then prevented from accidentally moving downwardly by a protuberance 98 on the cover 30 lying under the pin 72.

When the light bulb 96 is to be removed from socket 40 and replaced, cover 56 is pivoted downwardly with tab 100 whereupon member 22 is caused to slide downwardly on pins 32 and 34 by reason of the engagement of pin 72 with member 22 in slot 74. Flanged portion 70, of the cover 56, flexes slightly during downward movement as required to permit pin 72 to pass over protuberance 98. The cover 56 and member 22 are moved downwardly until the pins 32 and 34 are in the upper ends of the slots 24 and 26, and are therefore effective to prevent further downward movement. The light bulb 96 is then accessible at its bottom end portion and can be removed and replaced by an operator. When cover 56 is in its extreme downward position, pin 72 is on a line 102 extending steeply downwardly from the pivotal axis of the cover and is in a trough 104 formed in slot 72. As a consequence, cover 56 along with member 22 are prevented from being accidentally dislodged from their extreme lowered positions by slight upward pressures which may be exerted on the light bulb during removal.

After the replacement of a bulb, cover 56 is pivoted upwardly to impart upward movement to the light assembly 20 including member 22 and the bulb socket 40 with the new bulb therein. The assembly is moved up in the cover 30 until pin 72 is caused to ride over and assume a position above protuberance 98 at which time surface 94 of cover 56 is disposed in a bulb protecting position where it closes off the bottom end of the cover 30.

It is to be understood that the present disclosure relates to a preferred embodiment of the invention which is for purposes of illustration only and is not to be construed as limiting the invention. Numerous alterations and modifications will suggest themselves to those skilled in the art, and all such modifications which do not depart from the spirit and scope of the invention are intended to be included within the scope of the appended claims.

I claim:

1. In the head end portion of a sewing machine extending over a work supporting bed, a slidable member, a light bulb in a socket which is affixed on the slidable member, and a light transmitting bulb cover at the bottom end of the head end portion of the machine operably connected to said member for moving the member between an elevated position in which the bulb and socket are protected by surrounding structure of the head end portion of the machine and by the bulb cover in a station underlying the bulb, and a lowered position in which the bulb is rendered accessible under the head end portion of the machine for removal and replacement while the socket remains within the head end portion of the machine protected by the surrounding structure.

2. The combination of claim 1 wherein the bulb cover is a transparent plastic member.

3. The combination of claim 1 wherein the bulb cover is formed with a grill permitting light to pass therethrough.

4. The combination of claim 1 wherein the bulb cover and head end portion of the machine include mutually engageable structural formations for holding the said member in the elevated position.

5. The combination of claim 1 wherein the bulb cover is pivotally mounted in the head end portion of the machine and a pin on the bulb cover engages said member in a slot to impart movement to the member.

6. The combination of claim 5 including means for holding the said member and bulb cover in a bulb protecting position.

7. The combination of claim 1 including means limiting downward movement of said member.

8. The combination of claim 7 including means for holding said member in the elevated position.

9. The combination of claim 7 including means preventing accidental upward movement of the said member from the limited downward position thereof.

* * * * *